United States Patent [19]

Grose

[11] 4,355,951

[45] Oct. 26, 1982

[54] FULL ADMISSION PITOT PUMP

[75] Inventor: Ronald D. Grose, Omaha, Nebr.

[73] Assignee: InterNorth, Inc., Omaha, Nebr.

[21] Appl. No.: 311,975

[22] Filed: Oct. 16, 1981

Related U.S. Application Data

[63] Continuation-in-part of Ser. No. 146,136, May 2, 1980, Pat. No. 4,304,104.

[51] Int. Cl.[3] ..... F04D 1/14

[52] U.S. Cl. ..... 415/89

[58] Field of Search ..... 415/88, 89; 62/500

[56] References Cited

U.S. PATENT DOCUMENTS

| | | | |
|---|---|---|---|
| 3,384,024 | 5/1968 | King | 415/89 |
| 3,671,136 | 6/1972 | Omara et al. | 415/88 |
| 3,734,636 | 5/1973 | Leonard, Jr. | 415/88 |
| 3,776,658 | 12/1973 | Erickson | 415/89 |
| 3,795,457 | 3/1974 | Erickson et al. | 415/89 |
| 3,795,459 | 3/1974 | Erickson et al. | 415/89 |

*Primary Examiner*—Ronald C. Capossela
*Attorney, Agent, or Firm*—Zarley, McKee, Thomte, Voorhees & Sease

[57] ABSTRACT

A full admission pitot pump is described including a rotatable outer housing having at least a first rotor housing member and at least a first stator housing member secured thereto. The rotor housing member has a reduced diameter portion at its first end and an enlarged diameter portion at its second end. The stator housing member has an enlarged diameter portion at its first end which is secured to the enlarged diameter portion of the first rotor housing member. A stator is positioned within the housing and remains stationary as the outer housing is rotated. The first rotor housing member rotates with a housing and defines a plurality of spaced-apart passageways formed therein which communicate with a plurality of spaced-apart passageways formed in the stator. The medium to be pumped or compressed is supplied to the first end of a rotating rotor housing member with the vane members in the rotor housing member causing the medium to be centrifugally spun outwardly and supplied to the passageways in the stator housing member. The relationship of the outer housing, rotor and stator permits the pitot principle to be employed for efficient kinetic energy conversion to pressure.

9 Claims, 3 Drawing Figures

FULL ADMISSION PITOT PUMP

BACKGROUND OF THE INVENTION

This application is a continuation-in-part application of application Ser. No. 146,136 filed May 2, 1980 now U.S. Pat. No. 4,304,104.

This invention relates to a pitot pump and more particularly to a full admission pitot pump. In the co-pending application, a pitot heat pump was described. In the instant invention, a full admission pitot pump is described which may be used for compressing or pumping fluids and which may also be used in combination with a heat pump such as that described in the co-pending application.

Pitot pumps first appeared in U.S. patent history at the turn of the century. The evolution of the pitot pump can generally be found in U.S. Pat. Nos. 3,384,024; 3,795,459; 3,776,658 and 3,795,457.

Generally speaking, pitot pumps comprise a rotating fluid case pump having a stationary streamline pick-up tube extending from the center of the rotating case to near the inner maximum diameter of the rotating case so that the internal passage of the pick-up tube is bent to impact against the flow rushing past the tube. By such an arrangement, the bent end of the internal passage develops both the centrifugal force pressure of the rotating fluid and the impacted velocity pressure of the fluid rushing past the tube. The pressure so developed, forces the fluid through an internal passage in the pick-up tube and out the discharge of the pump.

Pitot pumps such as that described above have been found to perform generally satisfactorily for liquids but they do experience performance limitations especially for gases because only a single pick-up tube in each stage is employed. In the instant application, a pitot pump is described which may be termed a "full admission" pitot pump since a plurality of passageways or pick-up tubes are employed.

A principal object of the invention is to provide a full admission pitot pump.

A still further object of the invention is to provide a full admission pitot pump which may be used to compress or pump fluid or gases.

A still further object of the invention is to provide a full admission pitot pump which includes a shrouded rotor of special design which encloses a specially designed diffuser or stator.

A further object of the invention is to provide a full admission pitot pump which permits high radius ratios for improved centrifugal compression.

A still further object of the invention is to provide a full admission pitot pump employing a shrouded and vaned diffuser or stator to permit the pitot principle to be employed for efficient kinetic energy conversion to pressure.

These and other objects will be apparent to those skilled in the art.

DESCRIPTION OF THE PREFERRED EMBODIMENT

Figure 1:
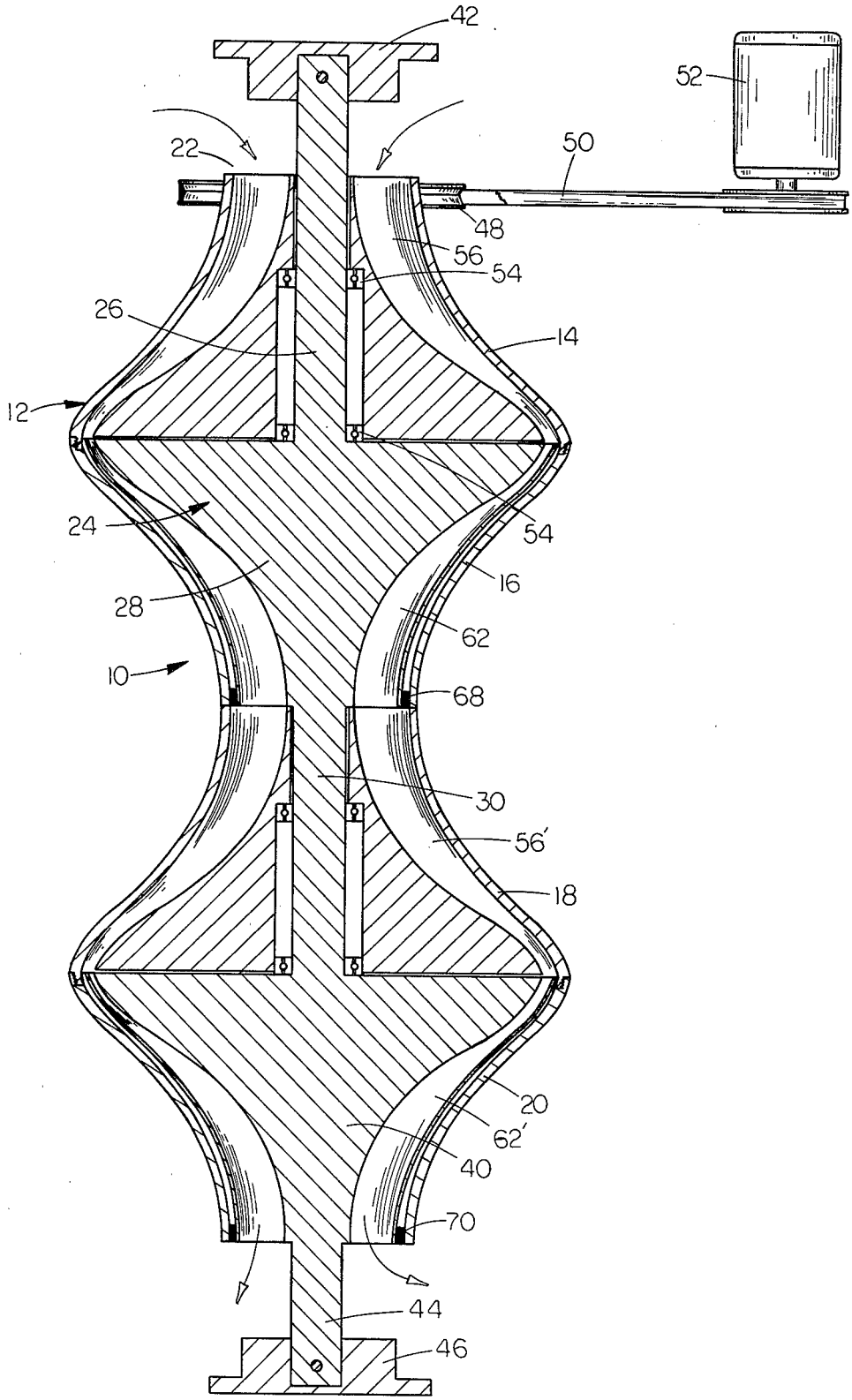
FIG. 1 is a longitudinal sectional view of the pitot pump of this invention.

FIG. 1 is a longitudinal sectional view of the full admission pitot pump which is preferred to generally by the reference numeral 10. The pitot pump of FIG. 1 is a two-stage pump and it should be clearly understood that the pump may employ as little as a single stage or as many stages as desired. Referring to FIG. 1, the numeral 12 refers generally to an outer housing comprising rotor housing member 14, stator housing member 16, rotor housing member 18 and stator housing member 20. Rotor housing member 14 includes an inlet end 22 which is in communication with the liquid or gas to be pumped or compressed. As seen in FIG. 1, the lower end of housing member 14 has a greater diameter than the upper end.

The upper end of stator housing member 16 is secured to the lower end of rotor housing member 14 by any convenient means. The lower end of stator housing member 16 has a diameter less than the upper end thereof and is secured to the upper end of rotor housing member 18 by any convenient means. Similarly, the lower end of rotor housing member 18 is secured by any convenient manner to the upper end of stator housing member 20.

The numeral 24 refers generally to a stator positioned within housing 12 and generally including stator portions 26, 28, 30 and 40. Stator portion 26 comprises a shaft which extends upwardly within the housing 12 and which is secured to any convenient support means referred by the reference numeral 42. Stator 24 also includes a shaft portion 44 which extends from the lower end of the housing 12 and which is mounted by any convenient means to support 46. To illustrate the principle clearly, the upper end of rotor housing member 14 is shown to have a sheave or pulley 48 mounted thereon having a belt 50 or the like extending therearound which is driven by motor 52. Actuation of the motor 52 causes the housing 12 to be rotated with respect to the stator as will be described in more detail. Although rotor housing member 14 is shown to be rotated by a motor 52 in the drawings, it should be understood that other suitable means could also be provided for rotating the rotor housing member.

Figure 2:
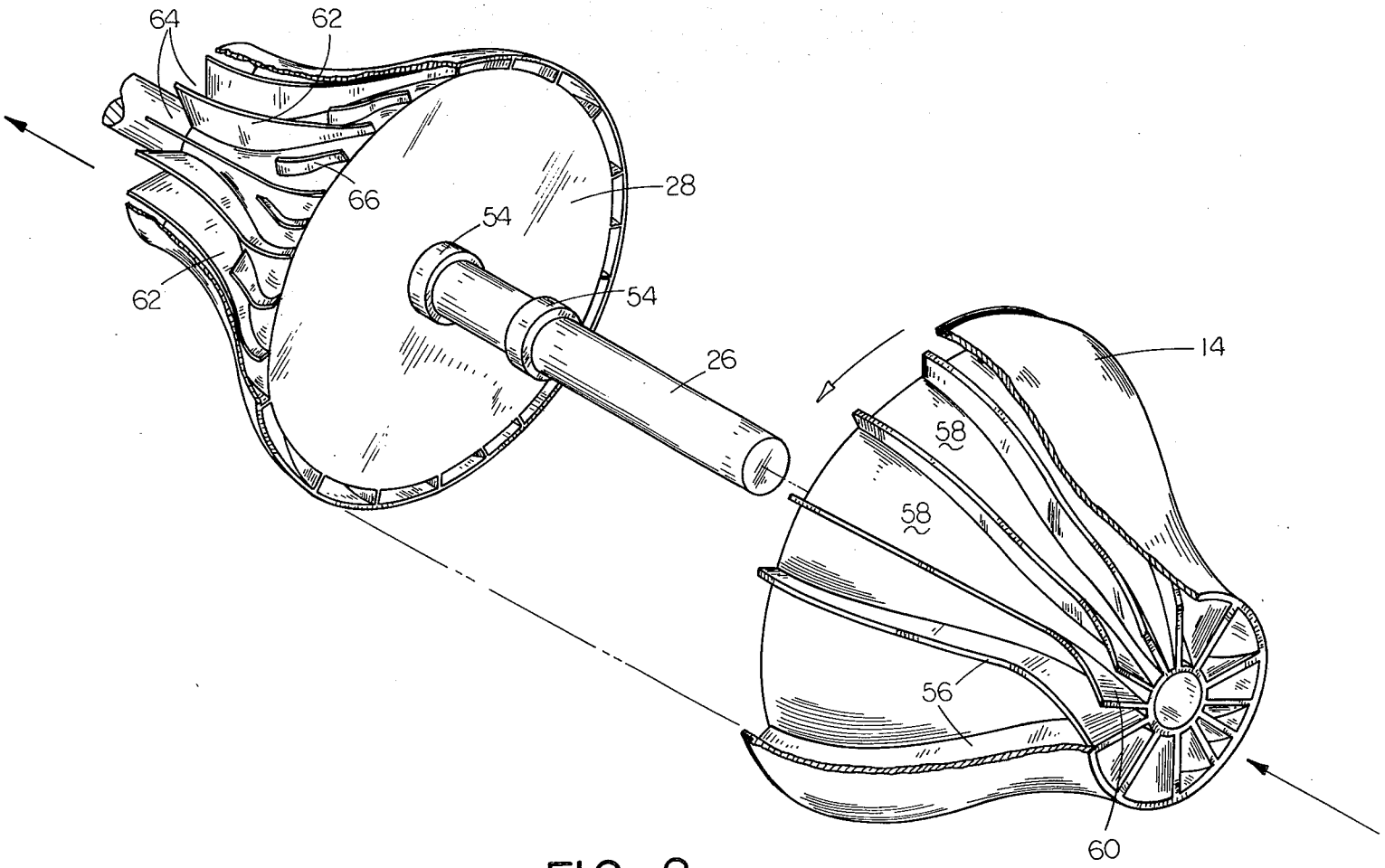
FIG. 2 is an exploded perspective upstream view with portions thereof cut away to illustrate the relationship of the rotor and stator.
Figure 3:
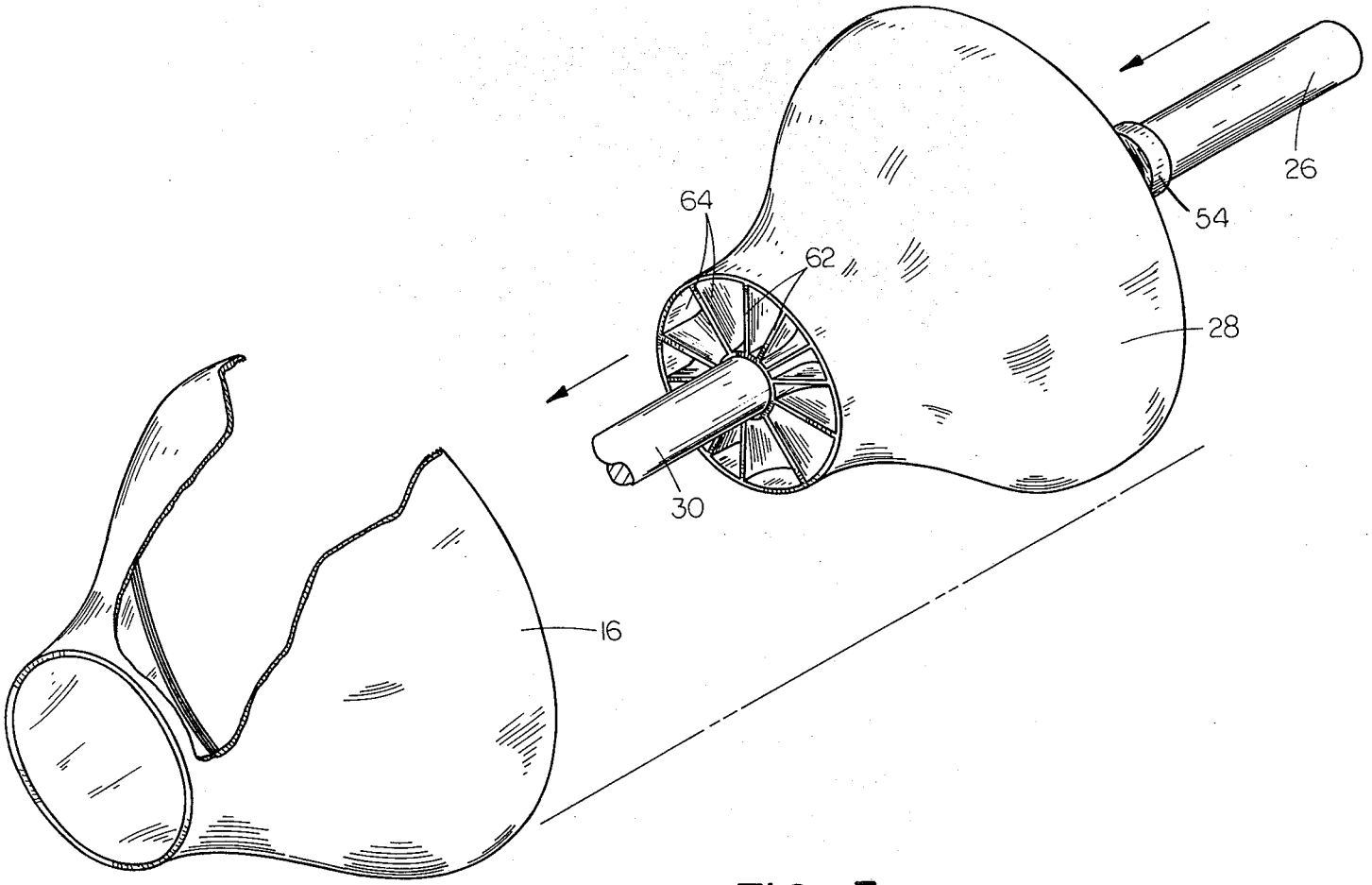
FIG. 3 is an exploded perspective downstream view with portions thereof cut away which illustrates the stator housing member and stator.

Rotor housing member 14 rotates with respect to stator portion 26 and has a suitable bearing means 54 positioned therebetween. Rotor housing member 14 is provided with a plurality of spaced-apart vane members 56 which extend from the upper to lower ends thereof in the manner best seen in FIG. 2 to define a plurality of spaced-apart passageways 58. As seen in FIG. 2, the upper ends of the vane members 56 are curved at 60 to aid in the efficient introduction of fluid thereinto. Each passageway is to configured that a certain cross-sectional area progression is maintained in proceeding down the passageway from the inlet and to the outlet end. At the inlet end of the passageway, a rapid increase in cross-sectional area occurs to diffuse the flow to a relatively low velocity from the inlet condition. This is done to minimize frictional losses within the passageway. For incompressible fluids, the passageway cross-sectional area remains constant from this point to the outlet end. For compressible fluids, a gradual reduction in cross-sectional area may be necessary to adjust for increasing fluid density. In this way, an optimum balance can be obtained between compression energy input and parasitic energy losses due to passageway friction (internal flow losses), "windage" and bearing drag. This, it is to be noted, is in contradistinction to conventional centrifugal impeller design where the fluid velocity increases rapidly reaching a very high value at the impeller outlet.

Stator portion 28 is positioned within the stator housing member 16 and is provided with a plurality of longitudinally curved vane members 62 defining a plurality of spaced-apart passageways 64 therebetween. It is also recommended that a plurality of smaller vane members 66 be provided to more efficiently diffuse the fluid to low velocities in passageways 64. Again, the cross-sectional area is to be varied to maintain low fluid velocities as in the impeller passageways.

Rotor housing member 18 includes a plurality of vane member 76 identical to vane members 56 and stator housing member 20 includes a plurality of vane members 62' identical to vane members 60.

In operation, the medium to be pumped or compressed is introduced into the intake end of rotor housing member 14 by any convenient means. As previously stated, outer housing 12 is rotated by the motor 52 so that the fluid supplied to the upstream ends of the passageways 58 is impinged upon the vane members 56 and centrifugally forced outwardly through the passageways 58. The fluid is discharged from the downstream ends of the passageways 58 to the inlet ends of the passageways 64 in the stationary stator portion 28 which converts the kinetic energy of the rapidly moving fluid to pressure energy by the diffusion process. The medium is passed through the passageways 64 in the stator portion 26 to the inlet ends of the passageways in the rotor housing member 18 which in turn discharges the medium to the inlet ends of the passageways in the stator portion 40. It should be noted that a seal means 68 is provided between the lower exterior portion of stator portion 28 and the lower interior portion of stator housing member 16. Likewise, a seal means 70 is provided between the lower exterior portion of stator portion 40 and the lower interior portion of stator housing member 20.

As previously described, as many stages of the pump may be employed as required since the pumps can be axially "stacked" to provide very high pressure ratios. As the medium passes through the various stages of the pump, the fluid is successively increasingly compressed (in the case of gases) or the fluid is successively increasingly pressurized (in the case of liquids) to achieve efficient pumping. The full admission pitot pump of this invention, by employing the shrouded and vaned diffuser or stator, permits the pitot principle to be employed for efficient kinetic energy conversion to pressure energy. It can be seen that the pitot pump of this invention employs a plurality of passageways in the stator which form a series of pitot probes or a series of passageways which function as pitot probes. The design of this invention by employing the full admission principle to provide low parasitic energy losses relative to compression energy expenditure thereby insuring that more efficient pumping or compression will occur.

Thus it can be seen that the full admission pitot pump of this invention accomplishes at least all of its stated objectives.

I claim:

1. A full admission pitot pump comprising, a rotatable outer housing means comprised of at least a first rotor housing member and at least a first stator housing member secured to said rotor housing member, said rotor housing member and said stator housing member having first and second ends, said rotor housing member having a reduced diameter portion at its said first end and an enlarged diameter portion at its said second end, said stator housing member having an enlarged diameter portion at its said first end and a reduced diameter portion at its said second end, the second end of said first rotor housing member being secured to the first end of said first stator housing member, a stator means positioned within said outer housing means, means for rotating said outer housing means relative to said stator means, said stator means comprising a first stator portion positioned in said first rotor housing member and a second stator portion positioned within said first stator housing member, said first rotor housing member including a first rotor portion which rotatably embraces said first stator portion, said first rotor housing member and said first rotor portion defining a plurality of spaced-apart passageways therebetween, said second stator portion having a plurality of spaced-apart passageways formed therein, said passageways in said rotor housing member and said second stator portion having inlet and discharge ends, the discharge ends of said passageways in said first rotor housing member communicating with the inlet ends of said passageways in said second stator portion, said passageways in said first rotor housing member extending outwardly from their said inlet ends to their said discharge ends, said passageways in said second stator portion extending inwardly from their said inlet ends to their said discharge ends, means for supplying fluid to the inlet ends of said passageways in said first rotor housing member, the rotation of said outer housing means causing the fluid supplied to said inlet ends of said passageways in said first rotor housing member to be progressively increasingly compressed as it passes from the inlet ends of the passageways in said first rotor housing member to the discharge ends of the passageways in said second stator portion.

2. The full admission pitot pump of claim 1 wherein said passageways in said first rotor housing member are defined by a plurality of spaced-apart vane members extending between said first rotor housing member and said first rotor portion.

3. The full admission pitot pump of claim 2 wherein said passageways in said first stator housing member are defined by a plurality of spaced-apart vane members.

4. The full admission pitot pump of claim 1 wherein said first end of said first rotor housing member forms the intake end of the pump and wherein the inlet ends of the passageways in said first rotor housing member occupy substantially the entire intake end of the pump.

5. The full admission pitot pump of claim 3 wherein said vane members are longitudinally curved.

6. The full admission pitot pump of claim 3 wherein said passageways in said first stator housing member form a plurality of pitot probes.

7. The full admission pitot pump of claim 3 wherein said vane members in said first stator housing member comprise diffusers.

8. The full admission pitot pump of claim 3 wherein said vane members in said first impeller member form diffusers.

9. A full admission pitot pump comprising, a rotatable outer housing means comprised of at least first and second spaced-apart rotor housing members and first and second spaced-apart stator housing members secured together, each of said rotor housing members and said first and second stator housing members having first and second ends, the second end of said first rotor housing member being secured to the first end of said first stator housing member, the second end of said first stator housing member being secured to the first end of said second rotor housing member, the second end of said second rotor housing member being secured to the first end of said second stator housing member, each of said rotor housing members having a reduced diameter portion at its said first end and an enlarged diameter portion at its said second end, each of said stator housing members having an enlarged diameter portion at its said first end and a reduced diameter portion at its said second end, a stator means positioned within said housing means, means for rotating said outer housing means relative to said stator means, said stator means comprising a first stator portion positioned in said first rotor housing member, a second stator portion positioned within said first stator housing member, a third stator portion positioned within said second rotor housing member, and a fourth stator portion positioned within said second stator housing member, said first rotor housing member including a first rotor portion which rotatably embraces said first stator portion, said first and second rotor housing members defining first and second rotor portions which extend around said first and third stator portions respectively, said first rotor housing member having a plurality of spaced-apart vane members extending inwardly therefrom, to said first rotor portion to define a plurality of passageways therebetween, said second stator portion having a plurality of spaced-apart vane members formed therein to define a plurality of passageways therein, said second rotor housing member having a plurality of spaced-apart vane members extending inwardly therefrom to said second rotor portion to define a plurality of passageways therebetween, said fourth stator portion having a plurality of spaced-apart vane members formed therein to define a plurality of passageways therebetween, all of said passageways having inlet and dicharge ends, the discharge ends of said passageways in said first rotor housing member communicating with the inlet ends of said passageways in said second stator portion, said passageways in said first rotor housing member extending outwardly from their said inlet ends to their said discharge ends, said passageways in said first stator housing member extending inwardly from their said inlet ends to their said discharge ends, the discharge ends of said passageways in said second stator portion communicating with the inlet ends of the passageways formed in said second rotor housing member, the discharge ends of said passageways in said second rotor housing member communicating with the inlet ends of said passageways in said second stator housing member, means for supplying fluid to the inlet ends of said passageways in said first rotor housing member, the rotation of said outer housing means causing the fluid supplied to said inlet ends of said passageways in said first rotor housing member to be progressively increasingly compressed as it passes through said housing, said passageways in said second rotor housing member extending outwardly from their said inlet ends to their said discharge ends, said passageways in said second stator housing member extending inwardly from their said inlet ends to their said discharge ends.

* * * * *